US006640168B2

(12) United States Patent
Kastner et al.

(10) Patent No.: US 6,640,168 B2
(45) Date of Patent: Oct. 28, 2003

(54) METHOD FOR DETECTING ERRORS IN A MOTOR VEHICLE ENGINE COOLING SYSTEM

(75) Inventors: Frank Kastner, Schwieberdingen (DE); Peter Wiltsch, Wimsheim (DE)

(73) Assignee: Robert Bosch GmbH, Stuttgart (DE)

( * ) Notice: Subject to any disclaimer, the term of this patent is extended or adjusted under 35 U.S.C. 154(b) by 4 days.

(21) Appl. No.: 09/936,549

(22) PCT Filed: Jan. 13, 2001

(86) PCT No.: PCT/DE01/00124

§ 371 (c)(1),
(2), (4) Date: Jan. 4, 2002

(87) PCT Pub. No.: WO01/53674

PCT Pub. Date: Jul. 26, 2001

(65) Prior Publication Data

US 2002/0157620 A1 Oct. 31, 2002

(30) Foreign Application Priority Data

Jan. 18, 2000 (DE) ..... 100 01 713

(51) Int. Cl.[7] ..... G06F 7/00
(52) U.S. Cl. ..... 701/36; 123/41.08; 123/41.15
(58) Field of Search ..... 701/36, 34, 29; 123/41.01, 41.05, 41.13, 41.08, 41.15

(56) References Cited

U.S. PATENT DOCUMENTS 5,353,757 A * 10/1994 Susa et al. ..... 123/41.29
6,044,808 A * 4/2000 Hollis ..... 123/41.1
6,223,700 B1 * 5/2001 Sano et al. ..... 123/41.02
6,321,696 B1 * 11/2001 Nishioka et al. ..... 123/41.15

FOREIGN PATENT DOCUMENTS

| | | |
|---|---|---|
| DE | 44 26 494 A | 2/1996 |
| DE | 197 55 859 A | 6/1998 |
| GB | 2 348 297 A | 9/2000 |

OTHER PUBLICATIONS

Patent Abstracts of Japan vol. 1999, No. 11, Sep. 30 & JP 11 173149 A, Jun. 29, 1999 & US 6 200 021 B1, Mar. 13, 2001.

* cited by examiner

*Primary Examiner*—William A. Cuchlinski, Jr.
*Assistant Examiner*—Olga Hernandez
(74) *Attorney, Agent, or Firm*—Michael J. Striker

(57) ABSTRACT

A method for detecting errors in a motor vehicle engine cooling system is proposed according to the invention, in which an algorithm is used to not only detect an error in the cooling system, but to also determine whether the thermostat valve or the temperature sensor are defective. Differentiated error detection is achieved in that a second temperature model band is calculated for the case in which the thermostat remains in the opened state. A first temperature model band is calculated for the case in which the cooling system is in order. By comparing the course of the curve for the measured actual temperature with the two temperature model bands, a selective diagnosis can be carried out and determine whether the temperature sensor or the thermostat valve is defective. No additional hardware expenditures are required.

12 Claims, 3 Drawing Sheets

METHOD FOR DETECTING ERRORS IN A MOTOR VEHICLE ENGINE COOLING SYSTEM

RELATED ART

The invention is based on a method for detecting errors in a motor vehicle cooling system. It is already known that the cooling-water temperature of a motor vehicle cooling system is controlled by opening and closing a thermostat valve. The temperature of cooling water is measured by a temperature sensor and fed to a computer that uses an algorithm and the measured values for the actual temperature to calculate a first temperature model band. By comparing the actual temperature with the first temperature model band, error detection is then carried out. Based on the result error message, however, it can be determined whether the thermostat valve or even the temperature sensor is defective. Nor is it possible to make a distinction between detects in the supply line or the display. On the other hand, there are legal requirements, in the United States, for example, which state that a defective cooling-water thermostat must be detected and displayed.

SUMMARY OF THE INVENTION

The method according to the invention for detecting errors in a motor vehicle engine cooling system has the advantage, however, that the individual trouble sources, such as a thermostat valve that does not close or a defective temperature sensor, can be detected selectively and displayed directly. This is achieved using the simulation of a second temperature model band that is calculated for the case in which a thermostat valve does not close. Using this simple method, detailed error detection can be carried out using a corresponding algorithm.

Advantageous further developments and improvements of the method indicated in the primary claim are possible using the measures listed in the dependent claims. It is particularly advantageous that the computer calculates the second temperature model band for a load-dependent temperature or different speeds. Based on the change of the course during the second temperature model band, a distinction can be made as to whether the thermostat valve actually no longer closes, or if there is a defect in the temperature sensor, such as an open circuit or an oscillation. By also taking the ambient temperature into account in particular when calculating the second temperature model band, the cause of the wrong indication can be advantageously determined with greater accuracy. This is an advantage in particular when further parameters such as the induction-air temperature, aspirated air mass, throttle-blade angle, and/or vehicle speed are included.

In order to be able to make an unequivocal claim about detecting errors in the cooling system, it is advantageous if the two temperature model bands are first analyzed when they no longer overlap.

On the other hand, a defective temperature sensor can be detected already if the actual temperature lies outside the two overlapping temperature bands for a specified period.

Since the second temperature model band is much flatter in shape than the first temperature model band due to the lower cooling-water temperature, a first unequivocal error diagnosis arises out of the course of the curve for the measured actual temperature.

The curve for the actual temperature is advantageously evaluated using a simple timer that tracks the actual temperature during a specified time interval. An error is present when the actual temperature lies outside the first temperature model band. If the course of the actual temperature actually lies outside both of the temperature model bands, it can be assumed that the temperature sensor is defective. If the curve for the actual temperature lies within the second temperature model band, however, this is an indication that the thermostat valve does not close, while the temperature sensor is in order. A possible cause can be, for example, that the valve is stuck in the opened state.

BRIEF DESCRIPTION OF THE DRAWINGS

A design example of the invention is presented in the diagram and described in greater detail in the subsequent description.

DESCRIPTION OF THE PREFERRED EMBODIMENTS

Figure 1:
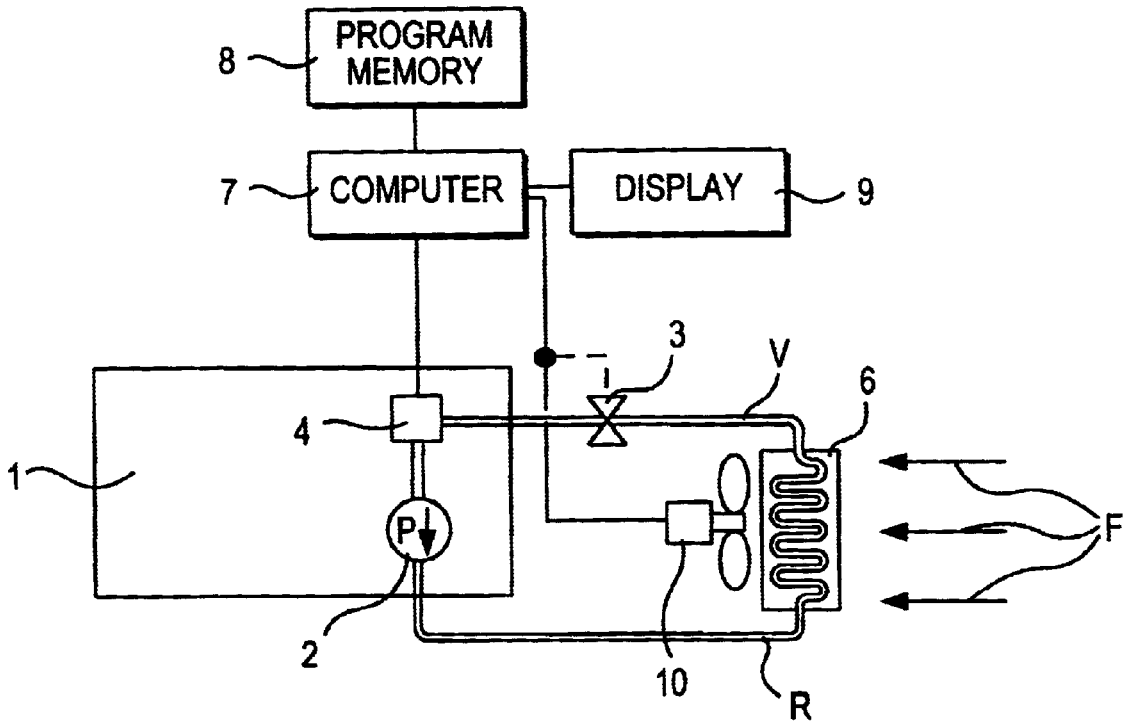
FIG. 1 shows a block diagram of a simplified motor vehicle engine cooling circuit.

FIG. 1 shows, in greatly simplified form, a block diagram of a cooling circuit having an engine 1, in which the cooling water is directed through a radiator 6 using a circulation pump 2 by way of a supply line V and a return line R. A thermostat valve 3, which is preferably mechanically operated, opens or closes depending on the coolant temperature. It should be closed at a low temperature, while it opens wide at a high temperature, thereby allowing a greater cooling-water stream to flow in the direction of the radiator 6. For reasons of completeness, it is also pointed out that the cooling effect of the radiator 6 can be intensified using one or more cooling fans 10 and/or the air stream F. A temperature sensor 4 is provided in a suitable location (preferably on the engine block) in the cooling-water circuit and detects the momentary actual temperature of the cooling water. This measured value is fed to a computer 7 that controls the function of the cooling fan 10 using a program stored in a program memory 8.

In an alternative embodiment of the invention, it is also foreseeable that the computer 7 electrically actuates the thermostat valve 3. If a defect is detected in the cooling system, it is output optically or acoustically at a display 9, for example, or it can also be read out by way of a corresponding service connection.

Figure 2:
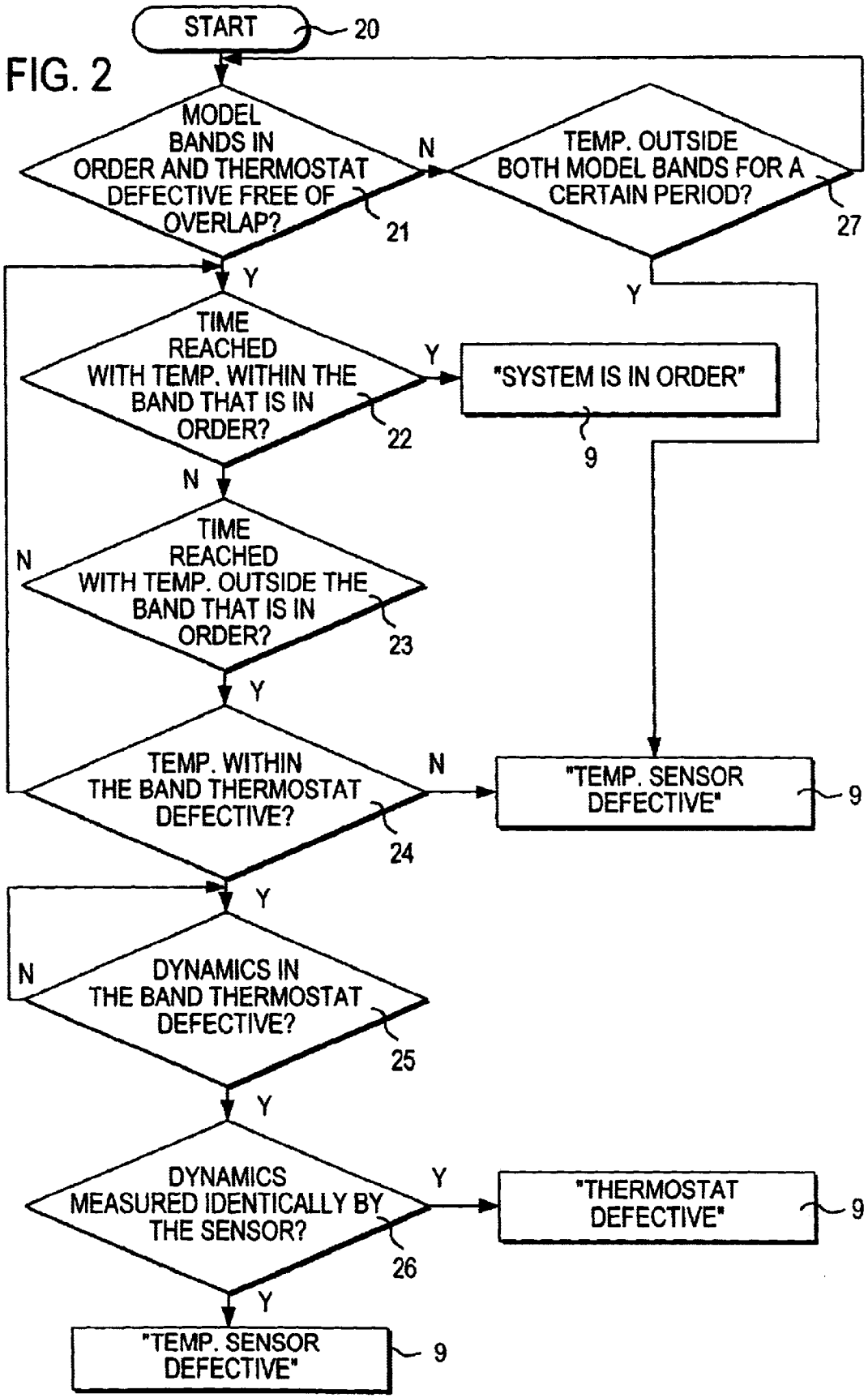
FIG. 2 shows a flow chart.
Figure 3:
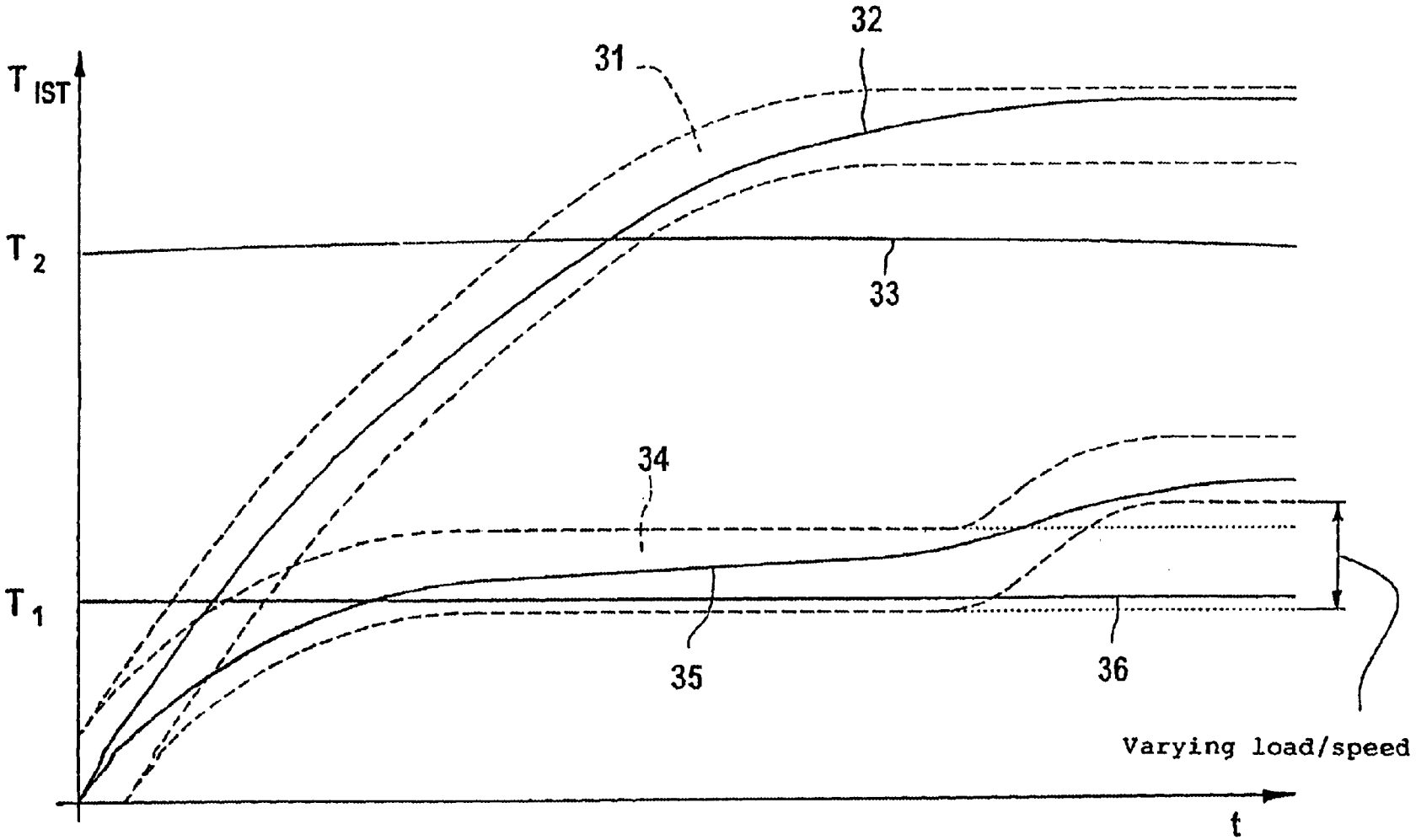
FIG. 3 shows a diagram with temperature model bands and temperature curves.

The mode of operation of this device is described in greater detail using FIGS. 2 and 3.

The invention is based on the idea of finding criteria for decision-making using a simple algorithm without additional hardware expenditure that provide a distinction between a defective thermostat valve and a defective temperature sensor. This is achieved in that, in addition to the first temperature model band, which is already known and which is usually determined using a corresponding software program, a second temperature model band is calculated. This second temperature model band is specified in such a way, however, that it the temperature course when a thermostat valve is defective, the flow-through valve of which is open. The temperature is measured within a specified time interval. Advantageously, the influence of load alteration or speed alteration can therefore be taken into consideration as well. The determination of this second temperature model band is reflected in the flow chart in FIG. 2. In practice, the algorithm is advantageously achieved using a program.

The flow chart in FIG. 2 shows the following steps. Starting in a Start position 20, a check is conducted in Position 21 to determine if the two temperature model bands are free of overlap or not. If this is not the case, a defective temperature sensor can be detected already in Position 27, as long as the actual temperature is located outside both model bands for a certain time. A corresponding output is generated at the Display 9. Otherwise, the check cycle is repeated. If both model bands are free of overlap, the temperature course of the actual temperature measured with temperature sensor 4 is first compared with the first temperature model band in Position 22. To determine the temperature model band, it is expressly pointed out that, to detect the tolerances that occur, the temperature course determined in the model calculation is defined with a corresponding tolerance band. If the measured actual temperature now runs within this first temperature model band within a specified period or time interval, the cooling system is in order. This means that both the temperature sensor and the thermostat valve function properly. If this is not the case, a check is carried out in Position 23 to determine if the actual temperature lies outside the first temperature model band. Timers are thereby started that display the respective, uninterrupted length of stay of the measured cooling-water temperature in the corresponding model temperature band. Continuous checks are therefore carried out in Position 23 to determine how long the actual temperature lies outside the first temperature model band. If this specified time interval is not achieved, the program returns to Position 22. In the other case, a check is carried out in Position 24 to determine if the actual temperature lies within the second temperature model band. If this is not the case, this is an indication that the temperature sensor 4 is defective. In this case, a corresponding error message can be output optically or acoustically at a display or by way of a speaker or via a corresponding service connection. The message could be: "Temperature Sensor Defective".

If, on the other hand, the measured actual temperature does lie outside the first temperature model band but within the second temperature model band within the specified period, then only a general error message such as "Cooling System Defective" can be output at first. In this case, it can not yet be unequivocally determined whether the error is due to a defective temperature sensor 4 having a random temperature display or a defective thermostat valve 3. For this case, a dynamic test is also required as further verification of the actual defective components.

Now that a general defect in the cooling system has been detected in Position 25, the dynamic test is carried out in Position 26. The dynamic test is carried out in such a way that the temperature course is tracked for a longer period of time, with consideration for load alteration or speed alteration as well, for example. Moreover, the ambient temperature can also be taken into consideration in order to improve the precision of the result. At the beginning of the dynamic test, the engine temperature—based on the actual temperature of the cooling water—is now compared with the second temperature model band and stored. The measurements are carried out continuously for a specified time interval and are preferably stored. If it becomes clear that the temperature sensor basically follows the actual temperature course according to the second temperature model band, it is to be concluded that the temperature sensor is functioning properly, because the observed temperature differences are identical except for the tolerance of the calculated model band. If the amount of the difference between the change of the second temperature model band and the change in measured actual temperature exceeds a specified threshold, however, it can be concluded that the temperature sensor is defective. A distinction can be made between the following cases:

1. The temperature sensor was unable to track the map-dependent dynamics of the model for a defective thermostat.
2. The temperature sensor 4 oscillates, i.e., it changes the displayed temperature without dynamics being present in the model.

Both cases indicate the presence of a defect in the temperature sensor, so that a corresponding error message for the defective temperature sensor can be output.

FIG. 3 shows the individual relationships once more in the temperature diagram presented. The first temperature model band 31 shows the state when the curve for the actual temperature 32 lies within the model band 31. If the temperature sensor displays the temperature $T_2$ instead, for example, it intersects the first temperature model band 31 only briefly. Since the temperature curve 33 spends the longest time outside the first temperature model band 31, it can be concluded that there is a defect in the temperature sensor 4. The lower model band (second temperature model band 34) shows the temperature increase of the cooling water, which corresponds to an open thermostat valve 3. This course is relatively flat, because the heat generated by the combustion engine is immediately dissipated by way of the radiator without the engine reaching its operating temperature. The second temperature model band increases slightly on the right side of the diagram only with a greater load or a higher speed. The course of the actual temperature within this second temperature model band is equivalent even when the temperature sensor 4 is intact. If the actual temperature of the temperature sensor 4 is basically constant at value $T_1$, however, it can be concluded that the temperature sensor 4 is defective, because this basically does not follow the right-hand course (FIG. 3) of the second temperature model band.

The presence of dynamics is obvious based on the course of the second temperature model band when the extent of the temperature change lies above a specified threshold. The thermostat valve 3 is defective when the extent of the difference between the temperature change in the second model band and the change in the measured actual temperature is less than a specified threshold. In this case, the computer 7 can output a corresponding error message for the defective thermostat valve 3.

As mentioned previously, the algorithm for calculating the temperature model bands is implemented in the form of a software program. This program can also be a component of an existing control program for engine functions or the like.

What is claimed is:

1. Method for detecting errors in the cooling system of a motor vehicle engine (1), whereby a thermostat valve (3) controls the temperature in the cooling-water circuit by opening or closing, and a temperature sensor (4) measures the actual temperature of the cooling water, and having a computer (7) that uses an algorithm to calculate a first temperature model band based on the values for the actual temperature and carries out error detection by making a comparison with the actual temperature, characterized in that the computer (7) calculates a second temperature model band for the cooling water temperature for a second temperature based on an open thermostat valve (3), that the computer (7) compares the course of the actual temperature with the second temperature model band, and that the computer (7), based on the result of the comparisons of the first and second temperature model band, determines if the temperature sensor (4) is defective or if the thermostat valve (3) is defective.

2. Method according to claim 1, characterized in that the computer (7) calculates the second temperature model band for a load-dependent temperature.

3. Method according to claim 1, characterized in that the computer (7) calculates the second temperature model band for a speed-dependent temperature.

4. Method according to claim 1, characterized in that the computer (7) calculates the second temperature model band as a function of the ambient temperature.

5. Method according to claim 1, characterized in that the computer (7) calculates the second temperature model as a function of further parameters such as the induction-air temperature, the vehicle speed, the aspirated air mass and/or the throttle-blade angle.

6. Method according to claim 1, characterized in that the computer detects a detective temperature sensor (4) as soon as the measured actual temperature for a specified period of time lies outside the two model bands.

7. Method according to claim 1, characterized in that the computer (7) begins further tests at the moment when the two temperature model bands do not overlap.

8. Method according to claim 1, characterized in that the computer (7) starts a timer for the temperature model band that runs as long as the respective actual temperature is located within the temperature model bands.

9. Method according to claim 1, characterized in that the computer (7) detects correct function when the actual temperature measured by the temperature sensor (4) is located in the first temperature model band and outside the second temperature model band within a specified time interval.

10. Method according to claim 1, characterized in that the computer (7) outputs an error message for a defective temperature sensor (4) when the actual temperature measured by the temperature sensor (4) is located outside the two temperature model bands during the specified time interval.

11. Method according to claim 1, characterized in that the computer (7) outputs an error message, preferably "Cooling System Defective", when the measured actual temperature is located outside the first temperature model band but within the second temperature model band during the specified measuring period.

12. Method according to claim 9, characterized in that the computer (7) tracks the course of the actual temperature measured by the temperature sensor (4), compares it with the course the second temperature model band, and, based on the course of the measured actual temperatures within the specified time interval, outputs an error message for a defective temperature sensor (4) or a defective thermostat valve (3).

* * * * *